US005285710A

United States Patent [19]

Chapman

[11] Patent Number: 5,285,710

[45] Date of Patent: Feb. 15, 1994

[54] ADJUSTABLE BRIDGE FOR A STRINGED MUSICAL INSTRUMENT

[76] Inventor: Emmett H. Chapman, 6011 Woodlake Ave., Woodland Hills, Calif. 91367-3238

[21] Appl. No.: 905,681

[22] Filed: Jun. 29, 1992

[51] Int. Cl.[5] ..... G10D 3/04

[52] U.S. Cl. ..... 84/307

[58] Field of Search ..... 84/298, 307, 299

[56] References Cited

U.S. PATENT DOCUMENTS

| | | | |
|---|---|---|---|
| 2,740,313 | 4/1956 | McCarty | 84/307 |
| 4,248,126 | 2/1981 | Lieber | 84/299 |
| 4,361,068 | 11/1982 | Schaller | 84/299 |
| 4,385,543 | 5/1983 | Shaw et al. | 84/298 |
| 4,453,443 | 6/1984 | Smith | 84/298 |
| 4,625,613 | 12/1986 | Steinberger | 84/298 |
| 4,649,789 | 3/1987 | Wadatsu | 84/298 |
| 4,742,750 | 5/1988 | Storey | 84/298 X |

*Primary Examiner*—William M. Shoop, Jr.
*Assistant Examiner*—Jeffrey W. Donels
*Attorney, Agent, or Firm*—J. E. McTaggart

[57] ABSTRACT

An adjustable bridge assembly for a stringed musical instrument utilizes individual adjustment blocks, one beneath each string, each fitted with a saddle screw having at its upper end a guidance groove supporting the corresponding string. The guidance groove may be shaped to accommodate different sized strings. The blocks, configured with elongated slots near each end engaged by screw fasteners, may be adjustably positioned prior to being fixed in place, thus enabling the bridge support point for each string to be set individually for good intonation and true octaves. The saddle screws, engaged in holes which are threaded into the block at an inclined angle so as to support each string at a well-defined point, allow each string's height above the fingerboard to be set independently for a desired tradeoff between ease of fingering and freedom from string-to-fingerboard buzz at maximum playing amplitude. In a preferred embodiment the blocks are mounted on a metal baseplate which is made to also serve as the tailpiece to which the string ends are anchored in slots which may be configured with dual widths to accept either small or large diameter strings.

15 Claims, 3 Drawing Sheets

ADJUSTABLE BRIDGE FOR A STRINGED MUSICAL INSTRUMENT

FIELD OF THE INVENTION

The present invention relates to stringed musical instruments and more particularly it relates to a bridge configuration which enables the string height and longitudinal bridge location to be adjustably set independently for each string.

BACKGROUND OF THE INVENTION

In stringed musical instruments such as guitars and the like, string tensioning adjustment is normally provided at one end of the instrument while at the other end the strings are bent over a bridge to a tailpiece where the strings are anchored; thus, with the strings tensioned against the bridge, the end point of the active region of string vibration is defined by the longitudinal location of the bridge. This is critical, relative to the frets on the fingerboard, for good intonation and true octaves.

Setting the height of each string above the keyboard involves a tradeoff between ease of fingering and the maximum available amplitude at the onset of "buzzing" of the string against the fingerboard. The optimum string height is not uniform from string to string: it varies according to the string material, type (round-wound or solid), diameter and tension.

Similarly the optimum longitudinal location for the bridge varies from string to string.

For these and other reasons, many instrument manufacturers and musicians value and seek the capability of setting the string height and the longitudinal bridge location independently for each string.

Along with requirements of elegance and producibility, the structure of the bridge and the tailpiece should made as stable as possible to minimize variations in tuning and playing characteristics.

The bridge should provide a well-defined support point which, by not absorbing vibrational energy from the strings, allows them to vibrate freely with full tonal quality and long sustain.

Many conventional instruments are designed such that there is an inherent structural dependence on body material such as wood or plastic, interposed between the bridge and the tailpiece, with a resultant risk of tuning variations due to dimensional instability.

DISCUSSION OF THE PRIOR ART

As examples of efforts to develop adjustable bridge structure: U.S. Pat. No. 2,740,313 to McCarty provides individual adjustment for each string but only longitudinally. Three-dimensional adjustment is provided in U.S. Pat. Nos. 4,248,126 to Lieber, 4,361,068 to Schaller and 4,385,543 to Shaw et al.

The McCarthy and Lieber patents exemplify the common practice of providing string height adjustment by mounting the entire bridge at two adjustable support points: this method fails to provide independent height adjustment of individual strings, offering instead only a compromise overall adjustment.

Independent string adjustment capability is provided by Schaller and Shaw, but with a tradeoff of greater complexity, i.e. a high number of parts required in the redundant support assemblies associated with each string.

McCarthy, Lieber and Shaw et al illustrate the usual practice of mounting the bridge assembly and the tailpiece separately to the instrument body.

OBJECTS OF THE INVENTION

It is a primary object of the present invention to provide an improved bridge, for a stringed musical instrument, in which each string support point may be adjusted longitudinally and in height above the fingerboard.

It is a further object of the invention that the bridge be made physically rugged, uncomplicated and easy to manufacture.

It is a further object to provide dimensional stability in the combined function of the bridge and tailpiece independent of materials used for the main body of the instrument.

It is a still further object to provide a bridge which produces pure tonal quality and long sustain by providing a stable string support point which does not absorb or distort the vibrations of the string.

SUMMARY OF THE INVENTION

The abovementioned objects have been realized in the bridge structure of this invention wherein a plurality of individual adjustment blocks are provided, one for each string, each mounted by a pair of screws located in end slots of the block, enabling independent longitudinal adjustment for each string. A saddle screw threaded into each block carries the corresponding string in a Y-shaped transverse notch at the upper end of the screw, providing individual string height adjustment. The blocks and their mounting slots may be dimensioned to additionally provide lateral string adjustment for varying string-to-string spacing. In a preferred embodiment the blocks are mounted onto a metal baseplate which also may be made to serve as the tailpiece to which the string ends are anchored.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
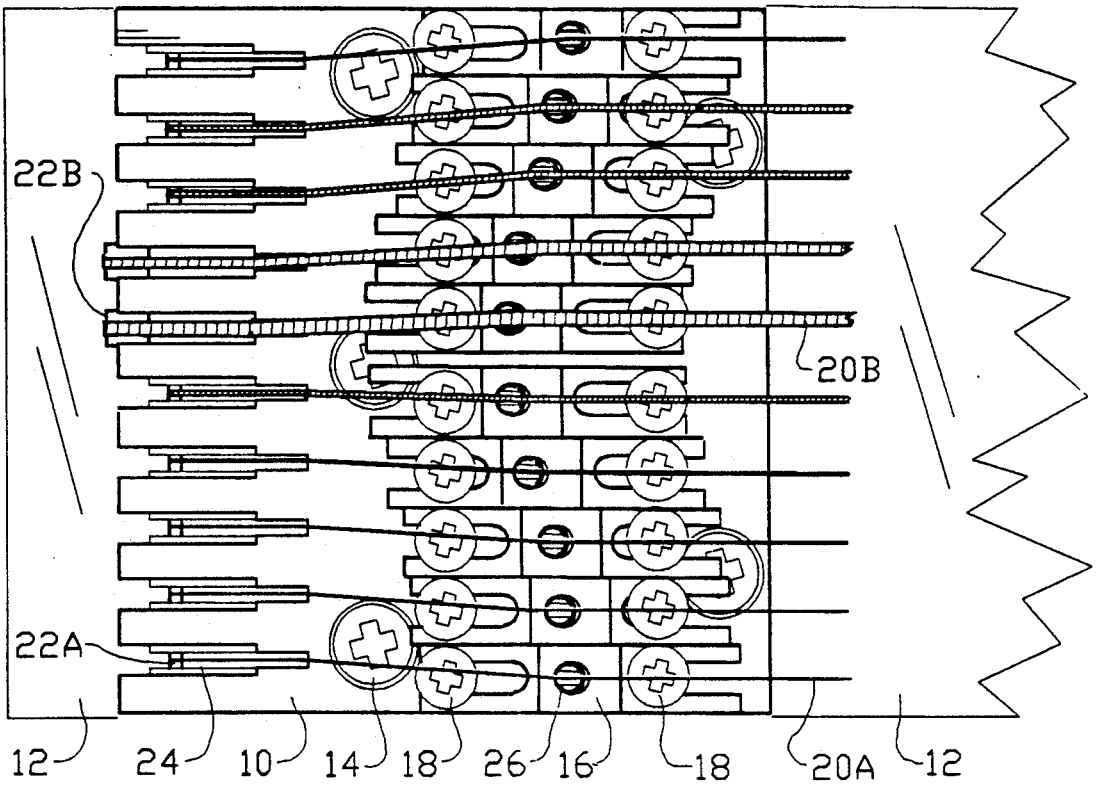
FIG. 1 is a top view of a combined bridge-tailpiece assembly for a ten-stringed instrument, illustrative of the present invention in a preferred embodiment.

In FIG. 1 is shown a top view of a portion of a ten stringed instrument having a combined tailpiece and adjustable bridge illustrative of the present invention in a preferred embodiment.

A metal baseplate 10 is attached to the instrument's main body 12 by countersunk flat head screws 14, typically five screws as shown.

An array of ten elongated metal adjustment blocks 16 are retained, side by side, against baseplate 10. Each block 16 is retained by a pair of pan head machine screws 18 engaging threaded holes in baseplate 10. Each block 16 is bifurcated at each end as shown to form elongated mounting openings which provide a range of longitudinal adjustment along each string. Ten strings of various thickness, including five solid strings such as 20A and five larger round-wound strings such as 20B are shown installed in place.

Each string is anchored at the tailpiece end of baseplate 10, to the left of the drawing as shown, by an eyelet such as eyelets 22A and 22B which are of a common type supplied with the strings. Each string is inserted into a corresponding slot 24 formed in baseplate 10 and is retained under tension in a guidance groove at the upper end of a corresponding saddle screw 26, one of which is threadedly mounted in each block 16.

The varying locations of the blocks 16 along the strings illustrate a typical setup where the end point of the vibrating portion of each string as defined by saddle screw 26 has been optimized independently for each string.

Typically blocks 16 are dimensioned and located to abutt each other, however they may be spaced further apart, for example the fifth and sixth blocks in the embodiment shown are spaced apart about 0.1" so as to form two uniformly spaced five string groups.

Figure 2:
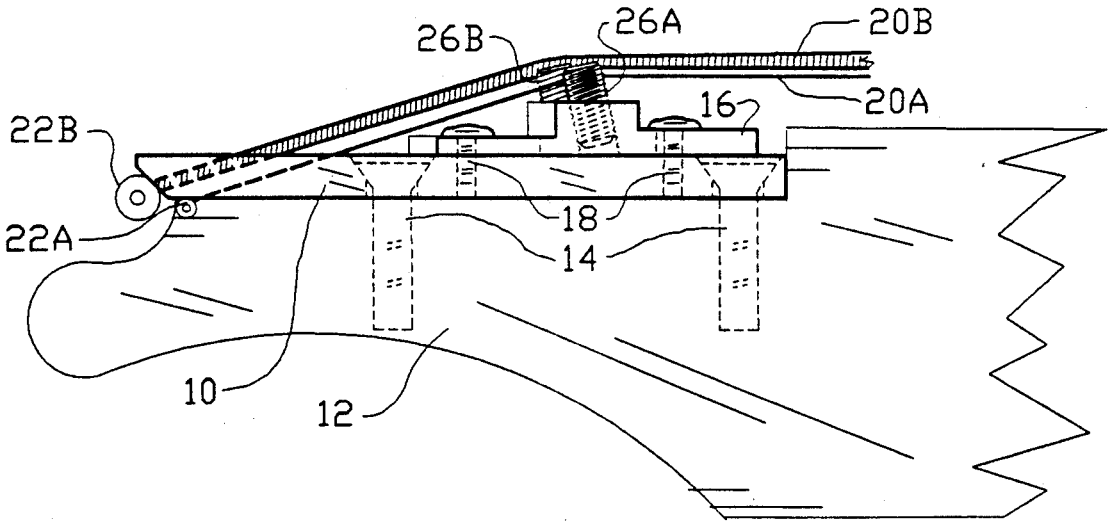
FIG. 2 is a side view of the assembly of FIG. 1.

FIG. 2 is a side view of the assembly of FIG. 1, showing baseplate 10 secured to the instrument's main body 12 by countersunk flat head screws 14. Block 16, clamped to baseplate 10 by two pan head machine screws 18, is seen to have a raised central pedestal region where saddle screw 26A engages a threaded hole, tilted as shown at an angle, typically 12 degrees from vertical. String 20A, typical of the solid strings, is shown anchored at the end by an eyelet 22A and inclining upwardly to the upper end of saddle screw 26A from where it leads horizontally toward the right to a fingerboard region and to a tensioning mechanism, not shown. Also shown is a larger sized round-wound string 20B supported on screw 26B which has been positioned by its block to the left of saddle screw 26A. It will be noted that in the tailpiece region, string 20B and its eyelet 22B are held at a different level than string 20A and its eyelet 22A: this is done by making each slot 24 to have dual passages each with a different width and depth.

Figure 3:
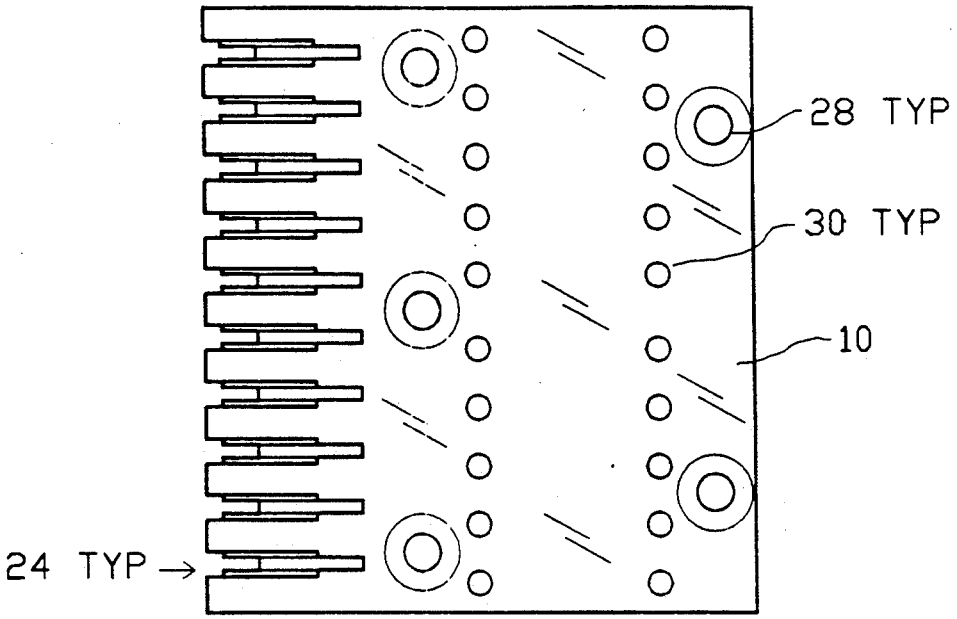
FIG. 3 is a top view of a baseplate of the assembly of FIGS. 1 and 2.

FIG. 3 is a top view of baseplate 10 of FIGS. 1 and 2, showing the locations of the ten slots 24, five countersunk mounting holes 28, and ten pairs of holes 30 for block retaining screws.

Figure 4:
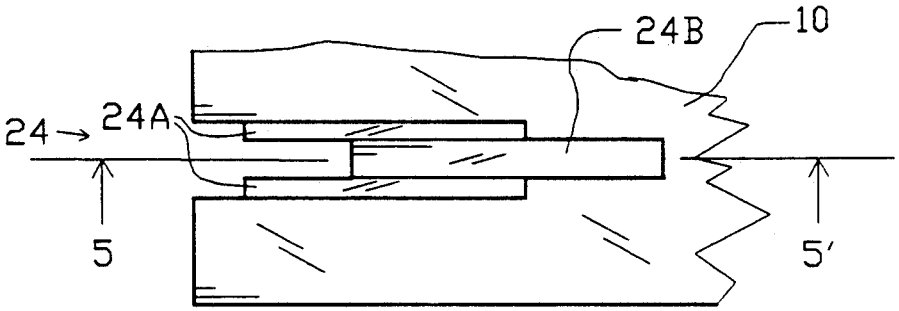
FIG. 4 is an enlarged view of a portion of FIG. 3 showing a dual-width slot.

FIG. 4 is an enlargement of lower left corner of FIG. 3 showing the dual width slot 24 having a wide passage, typically made 0.140" wide, transitioning at ledges 24A to a narrow passage, typically made 0.070" wide and extending down to a bottom surface 24B.

Figure 5:
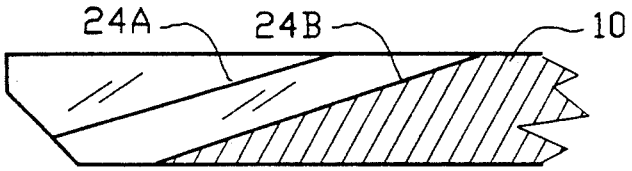
FIG. 5 is a side view of subject matter of FIG. 4.
Figure 6:
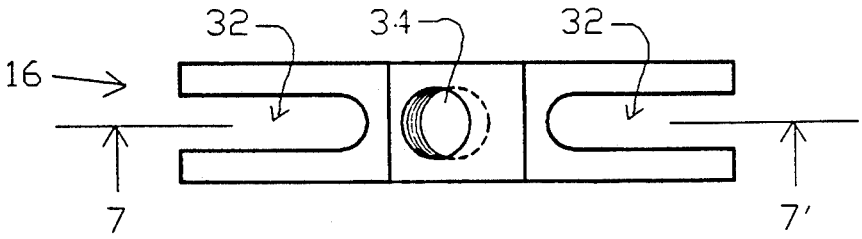
FIG. 6 is a top view of an adjustment block as used in the assembly of FIGS. 1 and 2.

FIG. 5 is a cross section taken at 5—5' of FIG. 4 showing the inclined location of ledge 24A defining the lower extent of the wide portion of slot 24, and bottom surface 24B defining the lower extent of the narrow portion of slot 24. FIG. 6 is an enlarged top view of an adjustment block 16 as shown in FIG. 1, showing the bifurcated ends forming mounting slots 32 and the threaded bore 34 for accepting a saddle screw. As an alternative to the bifurcated ends as shown, the ends could be closed so as to make the mounting slots 32 in the form of elongated apertures.

Figure 7:
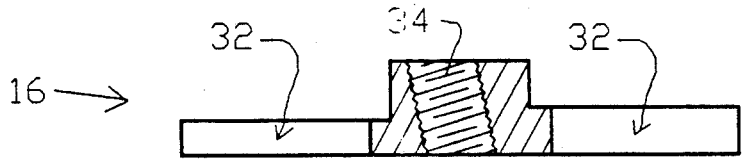
FIG. 7 is a cross-sectional side view of the block of FIG. 6.

FIG. 7 is a cross section through axis 7—7' of the adjustment block 16 FIG. 6 showing the region of mounting slots 32 and the sloping location of threaded bore 34, typically made to have a 10-40 thread. As a matter of design choice, the two regions of mounting slots 32 are made to have different thickness, as shown.

Figure 8:
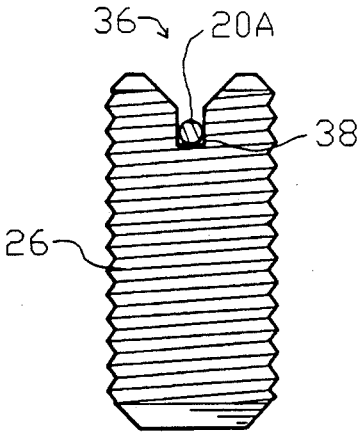
FIG. 8 is a cross-sectional side view of a saddle screw as used in the assembly of FIGS. 1 and 2, supporting a small solid string.

FIG. 8 is an enlarged cross sectional view of a saddle screw 26 such as screw 26A shown in FIG. 2, showing the cross sectional detail of the Y-shaped guidance groove 36 across the top of screw 26, and showing a small solid string 20A (as shown in FIGS. 1 and 2) supported in the bottom channel 38, typically made 0.030" wide and 0.040" deep. Typically screw 26 is made 0.375" long, with a 10–40 thread.

Figure 9:
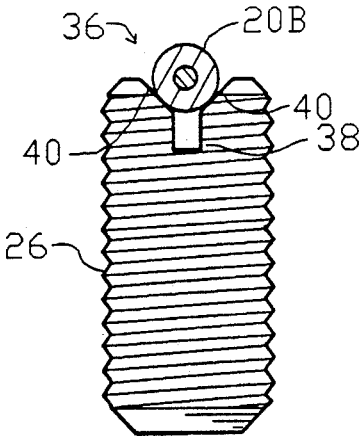
FIG. 9 is a cross-sectional side view of a saddle screw, as in FIG. 8, supporting a large round-wound string.

FIG. 9 shows saddle screw 26 as in FIG. 8 supporting a larger round-wound string 20B (as shown in FIGS. 1 and 2) on the sloping surfaces 40 of the Y-shaped guidance groove 36.

Bottom channel 38 as shown in FIGS. 8 and 9 also serves to accept a screwdriver blade for installation and adjustment which may be performed with the string removed.

Referring again to FIGS. 2 and 7, it will be noted that threaded mounting holes 34 and thus positioning of the saddle screws 26 are made to be sloped, typically at an angle of 12 degrees from vertical. Inclining the saddle screw guidance groove in this manner rather than making it parallel with the Main horizontal string portion ensures that the effective end point of string vibration is well defined at the point of entry into the groove, i.e. at the right hand edge of screw 26A, where each string is held securely under tension. This minimizes damping (i.e. energy absorption) of string vibration by the saddle screw and thus contributes to desirable prolonged sustaining of played notes.

With regard to the manner of using the above described embodiment of the invention: referring again to FIG. 1, in the manufacture of a new instrument, first the baseplate 10 is secured to the instrument body 12 by flat head screws 14. Then blocks 16 are assembled to the baseplate 10 by machine screws 18. Before each block 16 is locked in place by tightening the pair of screws 18, it is slid longitudinally to a predetermined setting which has been established from experience; possibly all of the blocks 16 may be set initially by means of a manufacturing template or jig. The saddle screws 26 are similarly preset to a predetermined height dimension or number of exposed threads, with the guidance groove aligned along the anticipated string direction. Then the strings are installed, first placing the eyelet end into the tailpiece grooves 24, then engaging the strings in the instrument's tuning mechanism at the other end of the fingerboard and tightening them while supporting each string in the corresponding saddle screw guidance groove. After tuning, the instrument is given a playing test for string intonation and playing action, and if necessary on any string, the block 16 and/or the saddle screw 26 may be reset, removing the string as required; then the string is put back in place and, if necessary, retuned.

As an alternative to including the tailpiece portion in the baseplate it may be designed to carry only the adjustment blocks 16, making the tailpiece portion a separate unit.

In a further alternative embodiment, it would be feasible to eliminate the baseplate by mounting the blocks 16 directly to the instrument body, particularly if the instrument body is made from a dimensionally stable material such as a suitable plastic or wood.

With regard to the spacing of the strings from each other: the present invention treats this as a matter of design choice in the layout of the baseplate and does not particularly address adjustability. However, it is anticipated that lateral string adjustment could be accomplished in the above-described embodiment by making the saddle screws 26 thread tightly enough into the blocks 16 that the guidance groove could be set at an angle to the string direction and thus provide lateral offset adjustment capability for each string. Such a concept could be further implemented with locking means such as a lock nut on each saddle screw 26.

Another method of providing lateral adjustment would be to widen the mounting slots in the blocks 16 and make the blocks narrower than the desired string spacing so as to leave a space between the blocks; thus the blocks could be shifted laterally as well as longitudinally prior to being locked in place by the mounting screws 18.

As alternatives to the Y-shaped groove in the saddle screws and the dual-width tailpiece slots for accommodating various string sizes, it would be feasible in a particular instrument design to make some or all of these items in a single-purpose configuration directed to a particular large/small string size.

The ten string embodiment described above is particularly suited for use in The Chapman Stick* and The Grid* (*Registered Trademarks of Stick Enterprises, Inc.) which are played with a two-handed tapping technique; however, the principles of the present invention are adaptable to a variety of stringed instruments with any number of strings and any desired string spacing, for example the common six string guitar configuration and using conventional guitar playing techniques.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An adjustable bridge assembly for a stringed musical instrument having a plurality of tensioned strings traversing an elongated fingerboard and a bridge region of a main instrument body, the assembly comprising:

a plurality of rigid elongated adjustment blocks, each associated with a corresponding one of the strings, disposed side by side in a row across the bridge region;

block fastening means, associated with said blocks, adapted to fasten each block in a fixed disposition relative to the fingerboard in a manner enabling initial positioning as well as subsequent release and repositioning of the block in at least a longitudinal direction of the fingerboard; and a plurality of saddle screws each (a) interposed between a corresponding one of said adjustment blocks and a corresponding one of said strings, (b) configured with a guidance groove, disposed diametrically across an end thereof, supporting the string, and (c) threadedly engaging the corresponding block so as to allow the height of the string from the fingerboard to be set adjustably.

2. The bridge assembly as defined in claim I wherein said guidance groove is made to have, in an approximately Y-shaped cross-section, an upwardly widening portion adapted to support strings of relatively large diameter and a lower central rectangular channel portion adapted to (a) act as a screwdriver slot for installing said saddle screw and setting individual string height, and (b) support strings of relatively small diameter.

3. The bridge assembly as defined in claim 1 wherein said block fastening means comprise:

in each of said blocks, a pair of mounting portions, one at each end thereof, each configured to provide a mounting slot, elongated in a direction parallel to the strings and defining a vertical passageway through the block; and a pair of screw fasteners, disposed one near each end of each of said blocks, one traversing each of the mounting slots, cooperating with said mounting slot and threadedly engaged in a manner allowing said block to be positioned adjustably in at least a direction parallel to that of the strings and to be thereupon secured in place relative to the instrument body.

4. The bridge assembly as defined in claim 3 wherein said screw fasteners are threadedly engaged with the instrument body so as to allow said blocks to be secured in place against the instrument body.

5. The bridge assembly as defined in claim 3 wherein said block fastening means further comprises a rigid baseplate attached against the instrument body, said screw fasteners being threadedly engaged with said baseplate so as to allow said blocks to be positioned adjustably and then secured in place relative to the instrument body.

6. The bridge assembly as defined in claim 3 wherein said mounting extensions of said block fastening means and said screw fasteners are configured and dimensioned in a manner to allow said block to be positioned adjustably in a longitudinal direction of the fingerboard prior to being secured in place.

7. The bridge assembly as defined in claim 3 wherein said mounting extensions of said block fastening means and said screw fasteners are configured and dimensioned in a manner to allow said block to be positioned adjustably in longitudinal and lateral directions of the fingerboard prior to being secured in place.

8. The bridge assembly as defined in claim 3 wherein each of said mounting portions of said blocks is made to have a bifurcated configuration defining a two-pronged fork forming an open-ended mounting slot.

9. The bridge assembly as defined in claim 3 wherein each of said mounting slots in said blocks is configured as an elongated aperture.

10. The bridge assembly as defined in claim 5 wherein said baseplate further comprises a tailpiece portion having a plurality of string-anchoring slots adapted to each anchor a corresponding one of the strings.

11. The bridge assembly as defined in claim 10 wherein each of said string-anchoring slots is made in a dual-width configuration adapted to accommodate both large and small sized strings.

12. The bridge assembly as defined in claim 1 wherein each of said blocks is provided with an elongated cylindrical threaded opening engaging one of said saddle screws, the opening and thus the saddle screw being disposed in a vertical plane which includes an active region of a corresponding string and being inclined from vertical in a direction away from the active region of the string.

13. The bridge assembly as defined in claim 1 further comprising a tailpiece portion defining a plurality of string-anchoring slots each made to have a dual width configuration adapted to accommodate both large and small sized strings.

14. An adjustable bridge assembly for a stringed musical instrument having a plurality of tensioned strings traversing an elongated fingerboard and a bridge region of a main instrument body, the assembly comprising:

a rigid baseplate, attached to the body in the bridge region thereof;

a plurality of rigid elongated adjustment blocks, each associated with a corresponding one of the strings and oriented parallel thereto, disposed side by side in a row across the baseplate, each of said blocks being configured to have at each of two opposite ends thereof an elongated mounting slot;

a pair of screw fasteners associated with each of said blocks, disposed near opposite ends thereof in the mounting slots, threadedly engaging said baseplate and cooperating with the mounting slots in manner allowing said block to be positioned adjustably in at least a longitudinal direction of the strings and to be thereupon secured in place against said baseplate; and a plurality of saddle screws, each threadedly engaging a corresponding one of said blocks, each saddle screw having at one end a transverse guidance groove configured in a Y-shaped cross-section having an upwardly widening portion adapted to support strings of relatively large diameter and a lower central rectangular channel portion adapted to (a) act as a screwdriver slot for installing said saddle screw and setting individual string height, and (b) support strings of relatively small diameter.

15. The bridge assembly as defined in claim 14 wherein said baseplate further comprises a tailpiece portion configured to define a plurality of string-anchoring slots adapted to each anchor a corresponding one of the strings.

* * * * *